US011946713B2

(12) United States Patent
Puha

(10) Patent No.: US 11,946,713 B2
(45) Date of Patent: Apr. 2, 2024

(54) RECOIL MANAGEMENT SYSTEM FOR A GUN

(71) Applicant: Eight Holdings LLC, Coeur D-Alene, ID (US)

(72) Inventor: Teodor Puha, Coeur D-Alene, ID (US)

(73) Assignee: EIGHT HOLDINGS LLC, Coeur D'Alene, ID (US)

( * ) Notice: Subject to any disclaimer, the term of this patent is extended or adjusted under 35 U.S.C. 154(b) by 98 days.

(21) Appl. No.: 17/528,672

(22) Filed: Nov. 17, 2021

(65) Prior Publication Data

US 2022/0244010 A1 Aug. 4, 2022

Related U.S. Application Data

(63) Continuation of application No. PCT/US2021/059776, filed on Nov. 17, 2021.

(60) Provisional application No. 63/114,840, filed on Nov. 17, 2020.

(51) Int. Cl.
*F41C 27/22* (2006.01)
*F41A 3/88* (2006.01)
*F41A 25/12* (2006.01)

(52) U.S. Cl.
CPC ..... *F41A 25/12* (2013.01); *F41A 3/88* (2013.01); *F41C 27/22* (2013.01)

(58) Field of Classification Search
CPC .... F41A 3/86; F41A 3/88; F41A 25/10; F41A 25/12; F41A 25/14; F41A 21/36; F41C 27/22
See application file for complete search history.

(56) References Cited

U.S. PATENT DOCUMENTS 2,679,192 A * 5/1954 Seeley ..... F41A 25/02 42/1.06
2,685,822 A * 8/1954 Walton ..... F16F 7/116 89/44.01
3,208,348 A * 9/1965 Lee ..... F41A 21/40 42/1.06
3,683,534 A * 8/1972 Davis ..... F41C 23/06 42/1.06
4,833,808 A * 5/1989 Strahan ..... F41A 21/28 42/1.06
4,986,018 A * 1/1991 McDonald, Jr. ..... F41B 5/1426 42/1.06
5,353,681 A * 10/1994 Sugg ..... F41A 25/16 89/43.01
8,418,389 B1 * 4/2013 Lukman ..... F41A 5/34 42/1.06

(Continued)

FOREIGN PATENT DOCUMENTS

KR 20050121525 A * 12/2005

*Primary Examiner* — Gabriel J. Klein
(74) *Attorney, Agent, or Firm* — Mark A. Pitchford; Eric B. Fugett; Pitchford Fugett, PLLC

(57) ABSTRACT

A system is disclosed for extending a recoil impulse of a gun. The system elongates the recoil impulse to spread the recoil energy over time and reduce felt (i.e., peak) recoil force. Although the system adds weight to a gun, the system reduces felt recoil beyond what is possible by simply adding weight to a gun by using an inertial weight on a spring to absorb and release energy. To prevent shaking, the inertial weight system is tuned to a gun so that the inertial weight hits a pair of stops at certain points in the gun's discharge action cycle.

18 Claims, 9 Drawing Sheets

(56) References Cited

U.S. PATENT DOCUMENTS

| | | | | |
|---|---|---|---|---|
| 9,921,022 | B1 * | 3/2018 | Noyce Merino | F41A 21/28 |
| 10,415,907 | B1 * | 9/2019 | Kincel | F41A 3/84 |

* cited by examiner

RECOIL MANAGEMENT SYSTEM FOR A GUN

CROSS-REFERENCES TO RELATED APPLICATIONS

This application claims priority to and hereby incorporates by reference in its entirety U.S. Provisional Patent Application No. 63/114,840 entitled "INERTIA DELAY SYSTEM FOR A FIREARM" filed on Nov. 17, 2020.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to guns. More particularly, this invention pertains to systems and methods for reducing felt recoil in a gun.

Guns such as firearms, black powder guns, and airguns produce recoil when discharged by virtue of an energy release propelling a projectile and gases forward from the muzzle of the gun. Airguns release energy over a relatively large period of time which lengthens the recoil impulse, and modern firearms utilizing smokeless powder release energy over a relatively very short period of time which shortens the recoil impulse. Thus, perceived recoil (usually closely correlated with peak recoil force) is generally much higher for a firearm than for an airgun, even when the guns have the same weight and release the same amount of energy per shot. Still, some modern airguns are powerful enough to produce significant peak recoil force. Different semi-automatic action types can affect felt recoil (e.g., gas direct impingement systems generally having a lower felt recoil than recoil operated firearms), but most systems still experience a relatively high peak recoil force. Manual action types (e.g., bolt, pump, break, etc.) have the highest peak recoil force for a given cartridge. Recoil has several negative consequences such as pushing a shooter off target and bruising a shooter's shoulder when firing long guns (e.g., rifles, shotguns, and carbines).

BRIEF SUMMARY OF THE INVENTION

Aspects of the present invention provide a system for extending a recoil impulse of a gun. The system elongates the recoil impulse to spread the recoil energy over time and reduce felt (i.e., peak) recoil force. Although the system adds weight to a gun, the system reduces felt recoil beyond what is possible by simply adding weight to a gun by using an inertial weight on a spring to absorb and release energy. To prevent shaking, the inertial weight system is tuned to a gun so that the inertial weight hits a pair of stops at certain points in the gun's discharge action cycle.

In one aspect, the recoil management system for a gun includes an inertial weight stop, a weight spring, and an inertial weight. The inertial weight stop is configured to attach to a barrel of the gun. The barrel extends longitudinally along a longitudinal axis. The inertial weight stop is configured to extend radially outward from the barrel when the recoil management system is properly installed on the gun. The weight spring is configured to attach to the actual weight stop and extend longitudinally along the barrel of the gun from the inertial weight stop when the recoil management system is properly installed on the gun. The inertial weight is configured to attach to the weight spring and connect to the inertial weight stop via the weight spring when the recoil management system is properly installed on the gun such that longitudinal movement of the inertial weight relative to the barrel is controlled by the weight spring.

In another aspect, a gun includes a recoil management system. The recoil management system includes an inertial weight stop, a weight spring, and an inertial weight. The inertial weight stop is configured to attach to a barrel of the gun. The barrel extends longitudinally along the longitudinal axis, and the inertial weight stop is configured to extend radially outward from the barrel parentheses, e.g. away from the longitudinal axis). The weight spring is configured to attach to the inertial weight stop and extend longitudinally along the barrel of the gun from the inertial weight. The inertial weight is configured to attach to the weight spring and connect to the inertial weight stop via the weight spring such that longitudinal movement of the inertial weight relative to the barrel is controlled by the weight spring.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
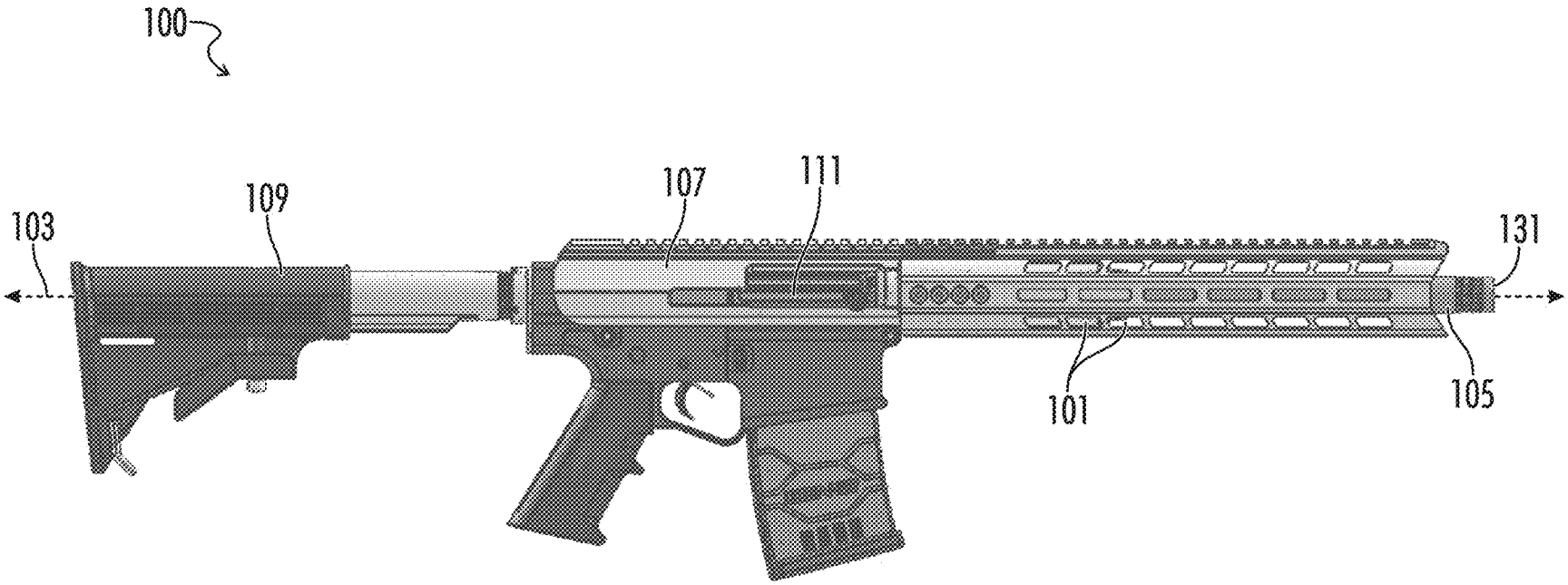
FIG. 1 is a side perspective view of a gun including an inertial recoil management system according to one embodiment of the invention.
Figure 2:
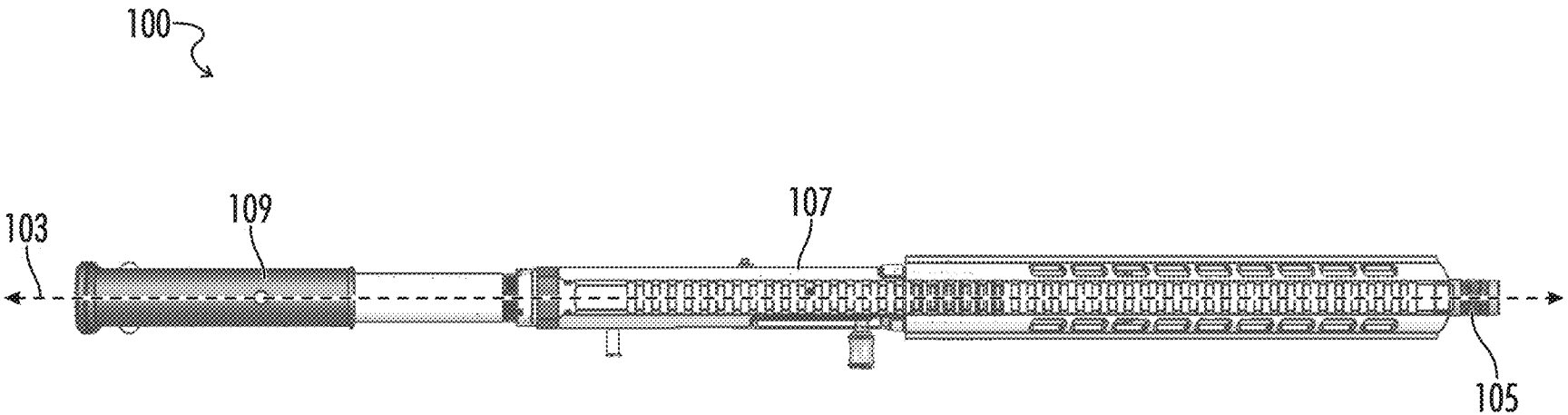
FIG. 2 is a top perspective view of the gun of FIG. 1.
Figure 3:
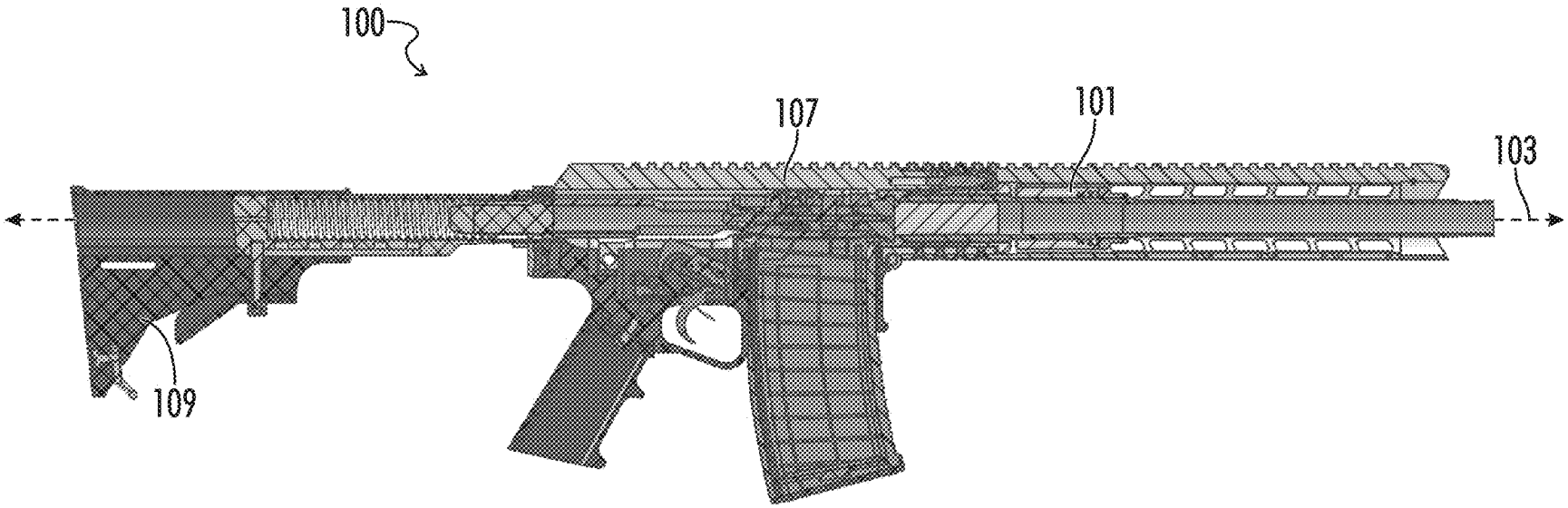
FIG. 3 is a cutaway side perspective view of the gun of FIG. 1.

As described herein, an upright position is considered to be the position of apparatus components while in proper operation or in a natural resting position and properly installed on a gun as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component. As described herein, the upright position of the recoil management system is when installed on a gun and the gun held in a generally horizontal firing ready position with the trigger below the action and the sights above the barrel as shown in FIG. 1.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-9, a gun 100 includes a recoil management system 101. The gun 100 has a longitudinal axis 103 that is generally synonymous with a bore axis of the gun 100. In one embodiment, the gun 100 includes a barrel 105 in upper receiver (i.e., receiver) 107, a stock (e.g., butt stock) 109, and a bolt 111. The barrel 105 extends longitudinally along the longitudinal axis 103. A muzzle 131 of the barrel 105 forms a front or forward end of the gun 100, and the stock 109 the back or rear of the gun 100. It is contemplated that the gun 100 may include other parts such as a trigger, grip, magazine, sights, ammunition, a suppressor, and flash hider, and/or other accessories. As described and shown herein, it will be assumed that the recoil management system 101 has been properly installed on the gun 100.

In one embodiment, the recoil management system 101 includes an inertial weight stop 301, a weight spring 303, and an inertial weight 305. The inertial weight stop 301 is configured to attach to the barrel 105 of the gun 100. The inertial weight stop 301 is configured to extend radially outward from the barrel 105. In one embodiment, the inertial weight stop 301 is attached to the barrel via corresponding threading in or on the inertial weight stop 301 and an outside surface of the barrel 105. In another embodiment, the inertial weight stop 301 is attached to the barrel 105 via pins, welding, brazing. It is also contemplated that the inertial weight stop 301 may be integrally formed with the barrel 105.

The weight spring 303 is configured to attach to the inertial weight stop 301. The inertial weight spring 303 extends longitudinally along the barrel 105 of the gun 100 from the inertial weight stop 301. In one embodiment, the inertial weight 303 extends rearward from the inertial weight stop 301. In one embodiment, the weight spring 303 is a stacked wave disc spring.

The inertial weight 305 is configured to attach to the weight spring 303 and connect to the inertial weight stop 301 via the weight spring 303 such that longitudinal movement of the inertial weight 305 relative to the barrel 105 is controlled by the weight spring 303. In one embodiment, the inertial weight 305 is a generally tubular annular body and is configured to surround a portion of the barrel 105 between the inertial weight stop 301 and a barrel stop of the gun 100.

Figure 4:
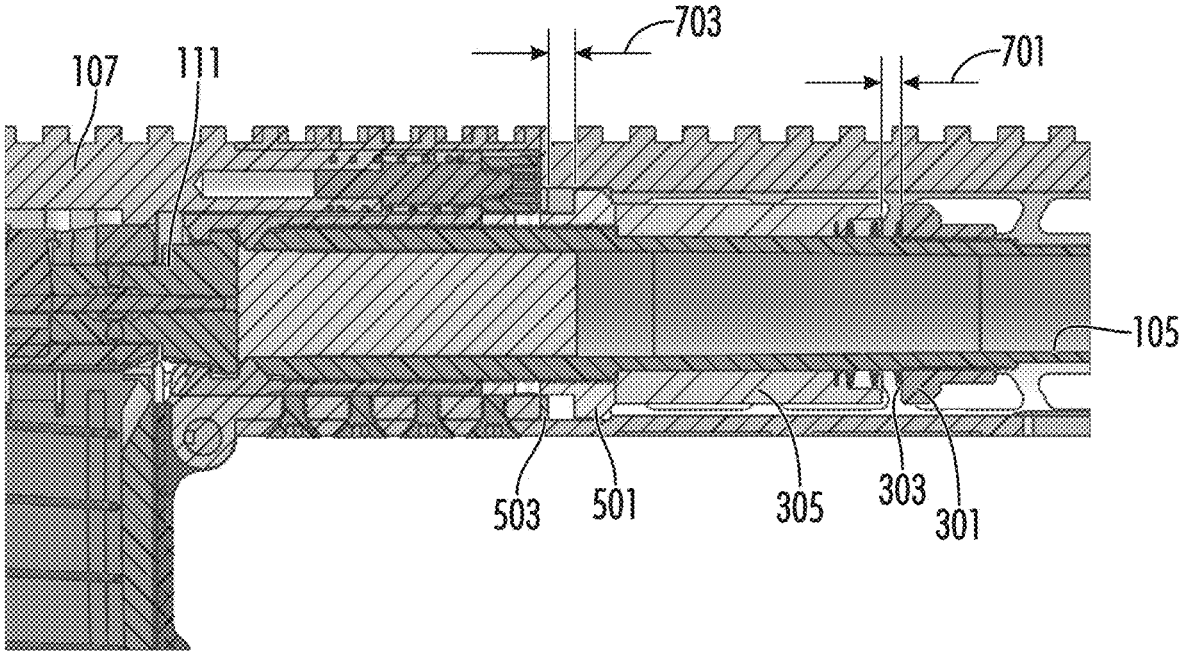
FIG. 4 is a side perspective cross section of the gun of FIG. 1 taken vertically along the longitudinal axis prior to a discharge action of the gun.
Figure 5:
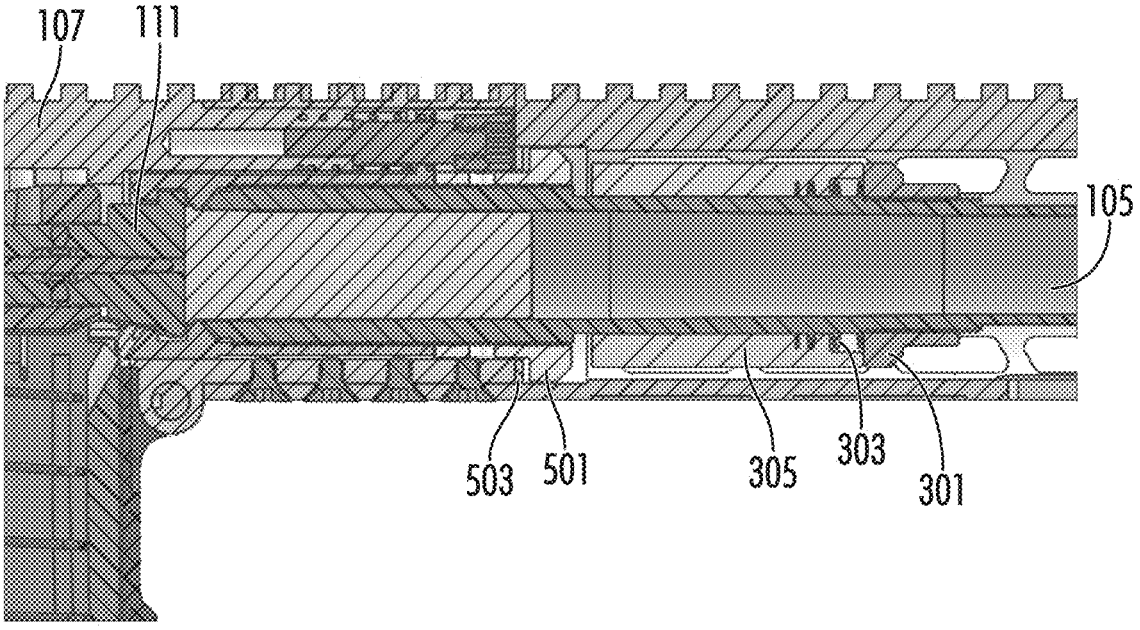
FIG. 5 is a side perspective cross section of the gun of FIG. 1 taken vertically along the longitudinal axis immediately after a discharge action of the gun has begun.
Figure 6:
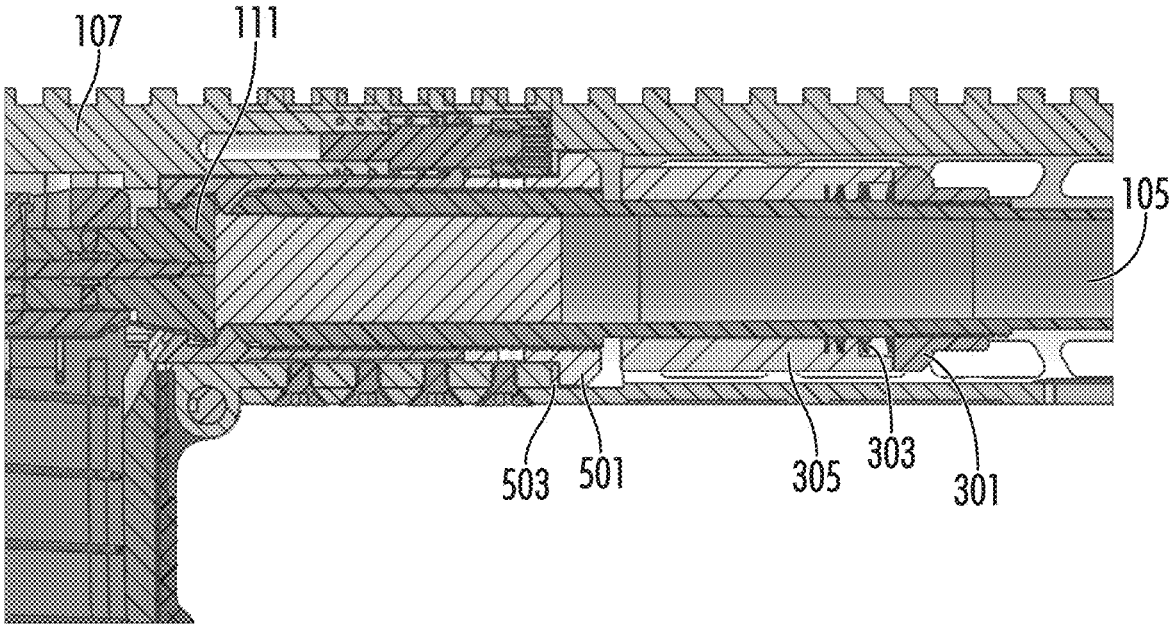
FIG. 6 is a side perspective cross section of the gun of FIG. 1 taken vertically along the longitudinal axis upon a barrel stop of the gun making contact with an impact ring of the gun.
Figure 7:
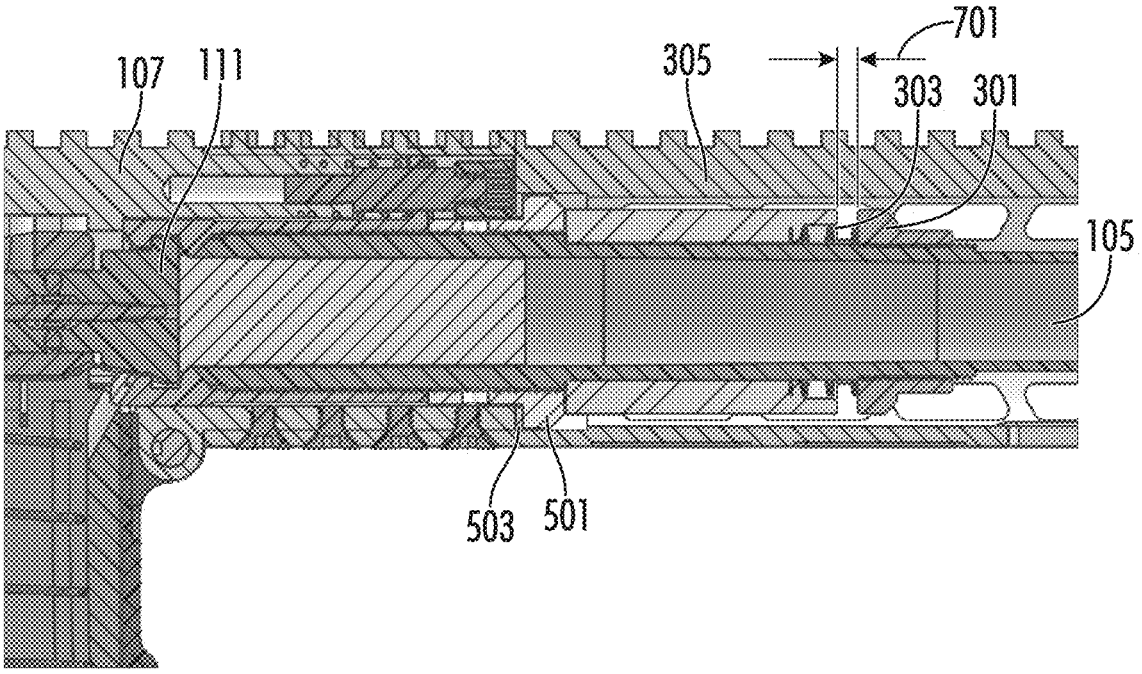
FIG. 7 is a side perspective cross section of the gun of FIG. 1 taken vertically along the longitudinal axis upon an inertial weight of the gun making contact with a barrel stop of the gun during the discharge action of the gun.
Figure 8:
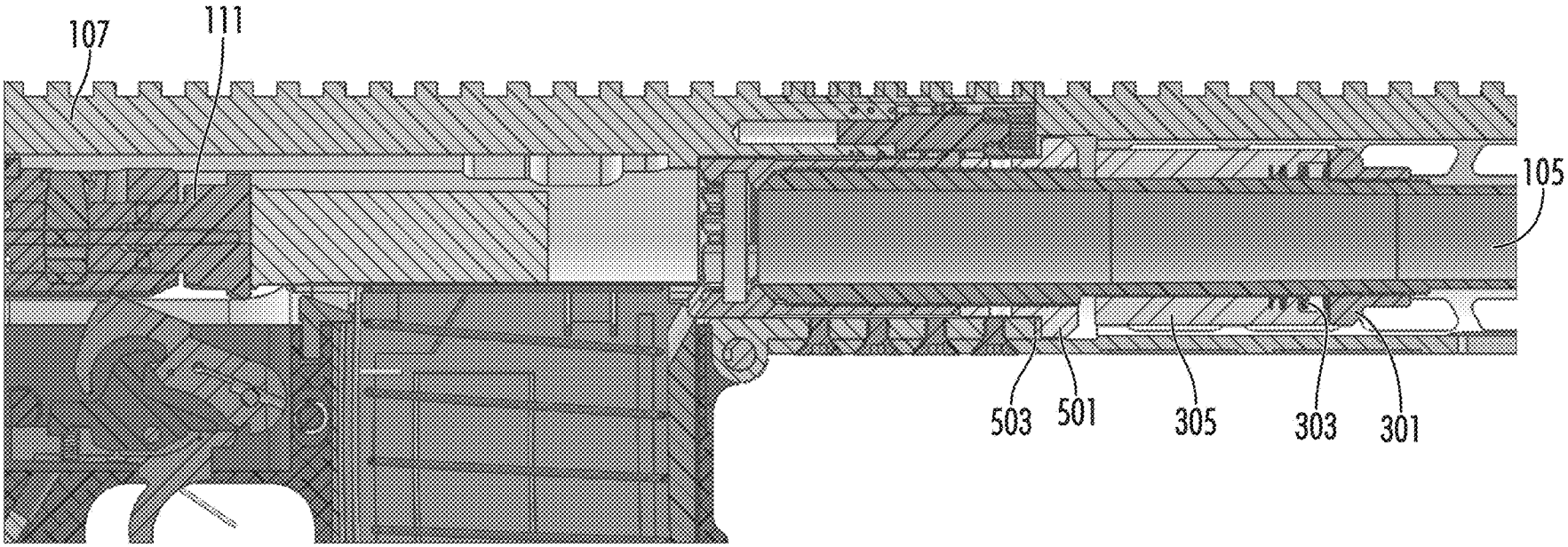
FIG. 8 is a side perspective cross section of the gun of FIG. 1 taken vertically along the longitudinal axis upon an inertial weight of the gun breaking contact with the breaking contact with a barrel stop of the gun during the discharge action of the gun while the bolt is back from the chamber of the gun.
Figure 9:
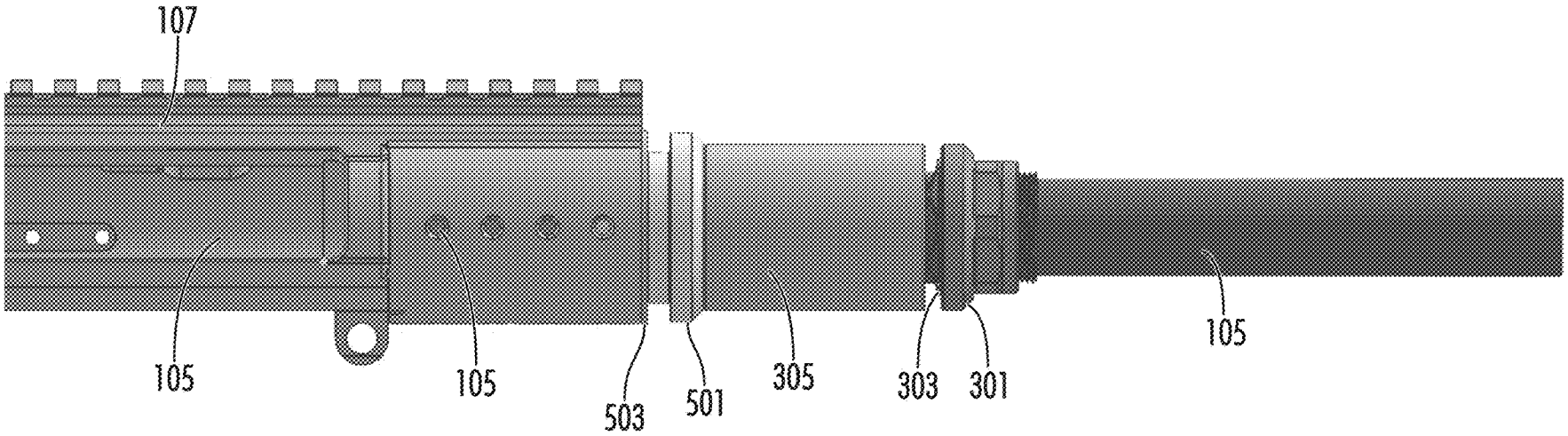
FIG. 9 is a side perspective partial diagram of the gun of FIG. 1 showing the components of the inertial recoil management system.

In operation, the inertial weight 305 moves longitudinally relative to the barrel 1052 alternatively impact or press upon via the inertial weight spring 303 the inertial weight stop 301 and a barrel stop 501 of the gun 100. Referring now to FIG. 4, the gun 100 is shown for or prior to discharging the gun 100. The inertial weight 305 inertial weight 305 is longitudinally spaced from the inertial weight stop 301 by the weight spring 303 such that the inertial weight 305 is in contact with the barrel stop 501 of the gun 100. Referring to FIG. 5, upon discharging the gun which begins the discharge cycle (i.e., discharge, case ejection, and new cartridge loading for an automatic or semi-automatic firearm) or action of the gun 100 rearward longitudinal motion of the barrel 105 moves the barrel stop 501 of the gun 100 away from the inertial weight 305 while moving the inertial weight stop 301 closer to the inertial weight 305 and into contact with the inertial weight, compressing the weight spring 303 (either partially or entirely compressing the weight spring 303 depending on the spring design). Referring to FIG. 6, a barrel assembly of the gun 100 (e.g., barrel 105 and barrel stop 501 along with various other accessories and components determined by the action type of the gun 100) contacts the front of the receiver 107 (i.e., in this gun design, the impact ring 503), halting rearward longitudinal movement of the barrel assembly relative to the receiver 107. Referring to FIG. 7, after the barrel assembly (i.e., in this action design, the barrel stop 501) contacts the front of the receiver (i.e., in this gun action design the impact ring 503), the inertial weight 305 is configured to contact barrel stop 501 to transfer energy from the inertial weight 305 to the barrel stop 501, and through the impact ring 503, receiver 107, stock 109, and other optional components of the gun 100 to a shooter or user of the gun 100. That is, the inertial weight 305 breaks contact with the inertial weight stop 301, and the weight spring 303 pushes the inertial weight into a forward face of the barrel stop 501 while the barrel stop is in contact with the impact ring 503. Referring to FIG. 8, as the bolt 111 is unlocked from the barrel 105 (i.e., the chamber of the barrel assembly) and is moving rearward or reaches its rearward apex (before beginning to move forward), the inertial weight 305 breaks contact with the barrel stop 501 and moves forward toward the inertial weight stop 301 compressing the weight spring 303 and potentially contacting the inertial weight stop 301 in some designs. The timing of the inertial weight 305 contacting the barrel stop 501 (e.g., front of receiver in a bolt action or pump action gun), breaking contact with the barrel stop 501, and moving toward the inertial weight stop 301 is determined by a balance of factors, and the system 1010 should be tuned for each action type and ammunition type. The factors controlling the timing and force reductions in the gun 100 and system 101 include a spring rate of the weight spring 303, a mass of the inertial weight 305, a muzzle energy of the gun 100, an initial or rest distance between the inertial weight 303 and the inertial weight stop 301, an initial distance between the inertial weight 305 and the front of the receiver or barrel stop 501 (the distance is zero in the illustrated design of FIG. 4), a reciprocating distance 703 of the barrel assembly (i.e., initial distance between the barrel stop 501 and impact ring 503), and a spring rate of a buffer spring (i.e., bolt return spring) of the gun 100. In one embodiment, these factors are balanced such that the inertial weight 305 impacts the barrel stop 501 while the bolt 111 is moving rearward and ejecting a casing from the action of the gun 100, and the barrel assembly and inertial weight return to an initial position before the bolt 111 begins moving forward to lock into the barrel assembly (typically reloading the gun with a new cartridge from a magazine as in the short recoil design used for illustration purposes herein).

It is contemplated that the inertia based recoil management system disclosed herein may be used with many types of actions including short and long recoil actions, gas direct impingement actions, pump actions, bolt actions, break actions, and virtually any other type of action. In fixed barrel designs, the barrel stop 501 does not reciprocate into the receiver 107, such that the front of the receiver is the barrel stop 501. In one embodiment, the inertial weight is initially spaced away from the barrel stop 501 before discharge of the gun 100. It is also contemplated that the barrel stop 501 may be an enlarged or machined area of the barrel 105 as opposed to a front end of the receiver such that the inertial weight 305 transfers energy to the barrel 105 and ultimately to the receiver 107, stock 109, and user.

It is contemplated within the scope of the claims that the longitudinal axis 103 of the recoil management system 101 is not the same as the bore axis of the gun 100. That is, in one embodiment, the recoil management system includes a tube or rod extending along the longitudinal axis 103. The inertial weight 305, spring 303, and inertial weight stop 301 as well as a rear stop (e.g., barrel stop 501) are mounted in or on the tube. The tube may be mounted to a rail system of the gun 100, to the barrel 105, or at an angle relative to the barrel 105. The longitudinal axis 103 may be generally parallel to the barrel 103 or at an angle (typically downward) relative to the barrel 103.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful RECOIL MANAGEMENT SYSTEM FOR A GUN it is not intended that such references be construed as limitations upon the scope of this invention except as set forth in the following claims.

What is claimed is:

1. A recoil management system for a gun, said system comprising:

an inertial weight stop configured to attach to a barrel of the gun, said barrel extending longitudinally along a longitudinal axis, and said inertial weight stop configured to extend radially outward from the barrel when the recoil management system is properly installed on the gun;

a weight spring configured to attach to the inertial weight stop and extend longitudinally along the barrel of the gun from the inertial weight stop when the recoil management system is properly installed on the gun; and an inertial weight configured to attach to the weight spring and connect to the inertial weight stop via the weight spring when the recoil management system is properly installed on the gun such that longitudinal movement of the inertial weight relative to the barrel is controlled by the weight spring, wherein, when the recoil management system is properly installed on the gun:

upon discharging the gun, rearward longitudinal motion of the barrel moves a barrel stop of the gun rearward and away from the inertial weight while moving the inertial weight stop closer to the inertial weight, compressing the weight spring; and upon discharging the gun, after a barrel assembly of the gun contacts an impact ring of the gun halting rearward longitudinal movement of the barrel assembly relative to a receiver of the gun, the inertial weight is configured to contact the barrel stop to transfer energy from the inertial weight to the barrel stop and receiver.

2. The recoil management system of claim 1, wherein, when the recoil management system is properly installed on the gun:

before discharging the gun, the inertial weight is longitudinally spaced from the inertial weight stop by the weight spring and in contact with a barrel stop of the gun.

3. The recoil management system of claim 1, wherein, when the recoil management system is properly installed on the gun:

upon discharging the gun, rearward longitudinal motion of the barrel moves a barrel stop of the gun rearward and away from the inertial weight while moving the inertial weight stop closer to the inertial weight, compressing the weight spring.

4. The recoil management system of claim 1, wherein, when the recoil management system is properly installed on the gun:

upon discharging the gun, rearward longitudinal motion of the barrel moves a barrel stop of the gun rearward and away from the inertial weight while moving the inertial weight stop closer to the inertial weight and into contact with the inertial weight, compressing the weight spring.

5. The recoil management system of claim 1, wherein, when the recoil management system is properly installed on the gun:

the inertial weight is configured to break contact with the barrel stop before a bolt of the gun begins moving forward after discharging the gun, during a discharge cycle of the gun.

6. The recoil management system of claim 1, wherein, when the recoil management system is properly installed on the gun:

a spring rate of the weight spring, a mass of the inertial weight, a muzzle energy of the gun, an initial distance between the inertial weight and inertial weight stop, an initial distance between the inertial weight and the barrel stop, a reciprocating distance of the barrel assembly, and a spring rate of a buffer spring of the gun are calibrated such that the inertial weight contacts the barrel stop while a bolt of the gun is in a back position, unlocked from a chamber of the barrel.

7. The recoil management system of claim 1, wherein, when the recoil management system is properly installed on the gun:

the barrel and inertial weight stop have corresponding threads for threading the inertial weight stop onto the barrel to attach the inertial weight stop to the barrel.

8. The recoil management system of claim 1, wherein, when the recoil management system is properly installed on the gun:

the inertial weight is generally tubular and is configured to surround a portion of the barrel between the inertial weight stop and a barrel stop.

9. The recoil management system of claim 1, wherein, when the recoil management system is properly installed on the gun:

the weight spring is a stacked wave disc spring.

10. The recoil management system of claim 1, wherein, when the recoil management system is properly installed on the gun:

before discharging the gun, the inertial weight is longitudinally spaced from the inertial weight stop by the weight spring and in contact with a barrel stop of the gun; and the barrel stop is a barrel stop of a short recoil action gun.

11. The recoil management system of claim 1, wherein, when the recoil management system is properly installed on the gun:

before discharging the gun, the inertial weight is longitudinally spaced from the inertial weight stop by the weight spring and in contact with a barrel stop of the gun; and the barrel stop is one of a front end of a receiver of the gun, an area of enlarged external diameter of the barrel, or a radial protrusion from the barrel.

12. The recoil management system of claim 1, wherein, when the recoil management system is properly installed on the gun:

before discharging the gun, the inertial weight is longitudinally spaced from the inertial weight stop by the weight spring and in contact with a barrel stop of the gun; and the barrel stop is one of a front end of a receiver of the gun, an area of enlarged external diameter of the barrel, or a radial protrusion from the barrel, and the barrel stop is integral with the barrel.

13. A gun comprising a recoil management system, said system comprising:

an inertial weight stop configured to attach to a barrel of the gun, said barrel extending longitudinally along a longitudinal axis, and said inertial weight stop configured to extend radially outward from the barrel;

a weight spring configured to attach to the inertial weight stop and extend longitudinally along the barrel of the gun from the inertial weight; and an inertial weight configured to attach to the weight spring and connect to the inertial weight stop via the weight spring such that longitudinal movement of the inertial weight relative to the barrel is controlled by the weight spring, wherein:

upon discharging the gun, rearward longitudinal motion of the barrel moves a barrel stop of the gun rearward and away from the inertial weight while moving the inertial weight stop closer to the inertial weight, compressing the weight spring; and upon discharging the gun, after a barrel assembly of the gun contacts an impact ring of the gun halting rearward longitudinal movement of the barrel assembly relative to a receiver of the gun, the inertial weight is configured to contact the barrel stop to transfer energy from the inertial weight to the barrel stop and receiver.

14. The gun of claim 13, wherein:

before discharging the gun, at rest, the inertial weight is longitudinally spaced from the inertial weight stop by the weight spring and in contact with a barrel stop of the gun.

15. The gun of claim 13, wherein:

upon discharging the gun, rearward longitudinal motion of the barrel moves a barrel stop of the gun rearward and away from the inertial weight while moving the inertial weight stop closer to the inertial weight, compressing the weight spring.

16. The gun of claim 13, wherein:

upon discharging the gun, rearward longitudinal motion of the barrel moves a barrel stop of the gun rearward and away from the inertial weight while moving the inertial weight stop closer to the inertial weight and into contact with the inertial weight, compressing the weight spring.

17. The gun of claim 13, wherein:

the inertial weight is configured to break contact with the barrel stop before a bolt of the gun begins moving forward after discharging the gun, during a discharge cycle of the gun.

18. The gun of claim 13, wherein:

a spring rate of the weight spring, a mass of the inertial weight, a muzzle energy of the gun, a distance between the inertial weight and inertial weight stop, a distance between the inertial weight and the barrel stop, a reciprocating distance of the barrel assembly, and a spring rate of a buffer spring of the gun are calibrated such that the inertial weight contacts the barrel stop before a bolt of the gun begins moving forward during a discharge cycle of the gun while the bolt is in unlocked from a chamber of the barrel.

* * * * *